US008410713B2

(12) United States Patent
Kumar et al.

(10) Patent No.: US 8,410,713 B2
(45) Date of Patent: Apr. 2, 2013

(54) LAMP END OF LIFE (EOL) DETECTION CIRCUIT

(75) Inventors: Nitin Kumar, Burlington, MA (US); Shashank Bakre, Woburn, MA (US); Christian Breuer, Newburyport, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 349 days.

(21) Appl. No.: 12/986,596

(22) Filed: Jan. 7, 2011

(65) Prior Publication Data

US 2011/0163685 A1 Jul. 7, 2011

Related U.S. Application Data

(60) Provisional application No. 61/293,037, filed on Jan. 7, 2010.

(51) Int. Cl.

| | |
|---|---|
| ***H05B 41/16*** | (2006.01) |
| ***H05B 41/24*** | (2006.01) |
| *H05B 37/00* | (2006.01) |
| *H05B 39/00* | (2006.01) |
| *H05B 41/14* | (2006.01) |
| *H05B 37/02* | (2006.01) |
| *H05B 39/02* | (2006.01) |
| *H05B 39/04* | (2006.01) |

(52) U.S. Cl. ..... 315/254; 315/200 R; 315/209 R; 315/212; 315/246; 315/247; 315/291

(58) Field of Classification Search ..... None
See application file for complete search history.

(56) References Cited

U.S. PATENT DOCUMENTS

| | | | | |
|---|---|---|---|---|
| 5,677,602 | A * | 10/1997 | Paul et al. | 315/224 |
| 6,680,585 | B2 * | 1/2004 | Trestman | 315/291 |
| 7,062,388 | B2 * | 6/2006 | Rivers et al. | 702/57 |
| 7,327,101 | B1 | 2/2008 | Chen et al. | |
| 2007/0296416 | A1 | 12/2007 | Lee et al. | |

OTHER PUBLICATIONS

Underwriters Laboratories, End of Life Protection Certification Notice LP No. 48, UL 1993, pp. 1-27.

Chang Gyun Kim, International Search Report and Written Opinion of the International Searching Authority for PCT/US11/20611, Aug. 29, 2011, pp. 1-7, Korean Intellectual Property Office, Daejeon, Republic of Korea.

* cited by examiner

*Primary Examiner* — Douglas W Owens
*Assistant Examiner* — Dedei K Hammond
(74) *Attorney, Agent, or Firm* — Shaun P. Montana

(57) ABSTRACT

A lamp driver circuit to selectively energize one or more lamps is provided. The inverter circuit has a transformer with primary and secondary windings to provide voltage to the lamps. A filter is connected to the primary winding to receive a primary winding signal representative of the voltage across the primary winding. The primary winding signal has a frequency spectrum and the filter detects a particular characteristic of the frequency spectrum that is indicative of an end of life (EOL) condition of the one or more lamps. A control circuit is connected to the inverter circuit and to the filter. The control circuit is configured to discontinue energizing of the one or more lamps by the inverter circuit when the particular characteristic of the frequency spectrum of the primary winding signal is detected by the filter.

20 Claims, 3 Drawing Sheets

LAMP END OF LIFE (EOL) DETECTION CIRCUIT

CROSS-REFERENCE TO RELATED APPLICATION

The present application claims priority of U.S. Provisional Patent Application No. 61/293,037, filed Jan. 7, 2010 and entitled "Lamp End of Life (EOL) Detect Circuit for Current Fed Electronic Ballast", the entire contents of which are hereby incorporated by reference.

TECHNICAL FIELD

The present invention relates to lighting, and more specifically, to electronic ballasts for lamps.

BACKGROUND

Typically, a ballast provides power to a lamp and regulates the current and/or power provided to the lamp. Lamps, such as fluorescent lamps, use a ballast to provide the proper starting voltage for the lamp and to limit the operating current once the lamp is ignited. One type of fluorescent lamp that is commonly used is a T5 lamp, due to the compact size and high lumen efficacy provided by the T5 lamp and corresponding ballast. However, lamps such as the T5 lamp that have a relatively small diameter (approx. 1.25 inches) are particularly likely to react undesirably when approaching the end of their lives.

For example, during its end of life (EOL) stage, a T5 lamp's end caps may overheat due to a depletion of an emission mix in the filament and due to the small spacing between the cathode and lamp wall. When this occurs, the lamp's end cap and holder may exceed a design temperature limit and detrimentally affect the reliability of the lamp system. For instance, the conditions may cause the lamp to crack.

SUMMARY

Embodiments of the invention relate to a lamp end of life detection circuit ("EOL detection circuit"). The EOL detection circuit detects when a lamp reaches the EOL stage and discontinues a power supply to the lamp as a result. The EOL detection circuit may be used in connection with a ballast having an inverter circuit that selectively energizes one or more lamps. The inverter circuit has an output transformer having a primary winding and a secondary winding. The EOL detection circuit is coupled to the primary winding in order to receive a primary winding signal that is representative of the voltage across the primary winding. For example, the EOL detection circuit may include a detect winding that is wound on the same core as the primary and secondary windings and coupled with the primary winding.

The EOL detection circuit includes a filter to receive the primary winding signal. The primary winding signal has a frequency spectrum. The filter detects a particular characteristic of the frequency spectrum of the primary signal that is indicative of an EOL condition of the one or more lamps. For example, the filter may detect a presence of a second harmonic in the frequency spectrum of the primary signal to indicate that the one or more of the lamps has reached the EOL stage. A control circuit is connected to the filter to determine when the EOL condition has been detected. The control circuit is also connected to the inverter circuit to cause the inverter circuit to discontinue energizing of the one or more lamps when the control circuit has determined that the EOL condition has been detected.

In an embodiment, there is provided a lamp driver circuit. The lamp driver circuit includes: an inverter circuit to selectively energize one or more lamps, the inverter circuit having a transformer to provide voltage to the one or more lamps, the transformer having a primary winding connected to a direct current (DC) voltage bus and a secondary winding to connect to one or more lamps; a filter connected to the primary winding to receive a primary winding signal representative of the voltage across the primary winding, wherein the primary winding signal has a frequency spectrum and the filter detects a particular characteristic of the frequency spectrum of the primary winding signal, and wherein the particular characteristic of the frequency spectrum is indicative of an end of life (EOL) condition of the one or more lamps; and a control circuit connected to the inverter circuit and to the filter, wherein the control circuit is configured to discontinue energizing of the one or more lamps by the inverter circuit when the particular characteristic of the frequency spectrum of the primary winding signal is detected by the filter.

In a related embodiment, the particular characteristic of the frequency spectrum of the primary winding signal detected by the filter may be a presence of an even harmonic having a magnitude that exceeds a threshold value. In another related embodiment, the particular characteristic of the frequency spectrum of the primary winding signal detected by the filter may be a presence of a second harmonic having a magnitude that exceeds a threshold value.

In yet another related embodiment, the inverter may be a half bridge resonant inverter having a first switch and a second switch, the first switch and the second switch each having a base terminal, an emitter terminal, and a collector terminal, wherein the lamp driver circuit may further include a shut down circuit connected to the second switch and to the control circuit to short the base terminal and the emitter terminal of the second switch when the particular characteristic of the frequency spectrum of the primary winding signal is detected by the filter.

In still another related embodiment, the inverter circuit may be adapted to selectively energize a plurality of lamp configurations, wherein each of the plurality of lamp configurations may have a particular frequency spectrum that is indicative of an EOL condition for the lamp configuration, and wherein the filter may be configured to detect the particular characteristic of each of the particular frequency spectrums for the plurality of lamp configurations. In yet still another related embodiment, the primary winding may include a first primary winding and a second primary winding that is coupled with the first primary winding, and the filter may be connected to the second primary winding to receive the primary winding signal.

In another related embodiment, the filter may be a bandpass filter having a center frequency that is substantially equivalent to an even harmonic of the frequency spectrum of the primary winding. In still another related embodiment, the lamp driver circuit may be adapted to use in a ballast, the ballast including: an electromagnetic interference filter configured to receive alternating current (AC) voltage from a power source; a rectifier connected to the electromagnetic interference filter to convert the alternating current (AC) voltage to direct current (DC) voltage; a power factor control circuit connected to the rectifier to produce a DC voltage output; and a DC voltage bus connected to the power factor control circuit to receive the DC voltage output from the power factor control circuit.

In another embodiment, there is provided a method of detecting an end of life (EOL) condition for one or more lamps connected to a ballast and energized by the ballast, the ballast having a transformer. The method includes: detecting a voltage signal across a primary winding of the transformer; determining whether the voltage signal includes an even harmonic having a magnitude that exceeds a threshold value; and shutting down an inverter circuit of the ballast when the voltage signal is determined to include an even harmonic having a magnitude that exceeds the threshold value.

In a related embodiment, the even harmonic consists of the second harmonic. In another related embodiment, determining may include determining whether the voltage signal includes an even harmonic that exceeds a threshold value for at least a pre-defined period of time, and shutting down may include shutting down an inverter circuit of the ballast when the voltage signal is determined to include an even harmonic having a magnitude that exceeds the threshold value for at least the pre-defined period of time. In yet another related embodiment, shutting down may include turning on a shut-down switch that is connected to a half bridge inverter.

In another embodiment, there is provided a lamp system. The lamp system includes: an electromagnetic interference filter configured to receive alternating current (AC) voltage from a power source; a rectifier connected to the electromagnetic interference filter to convert the alternating current (AC) voltage to direct current (DC) voltage; a power factor control circuit connected to the rectifier to produce a DC voltage output; a DC voltage bus connected to the power factor control circuit to receive the DC voltage output from the power factor control circuit; an inverter circuit to selectively energize one or more lamps, the inverter circuit having a transformer to provide voltage to the one or more lamps, the transformer having a primary winding connected to a direct current (DC) voltage bus and a secondary winding to connect to one or more lamps; a filter connected to the primary winding to receive a primary winding signal representative of the voltage across the primary winding, wherein the primary winding signal has a frequency spectrum and the filter detects a particular characteristic of the frequency spectrum of the primary winding signal, and wherein the particular characteristic of the frequency spectrum is indicative of an end of life (EOL) condition of the one or more lamps; and a control circuit connected to the inverter circuit and to the filter, wherein the control circuit is configured to shut off the inverter circuit when the particular characteristic of the frequency spectrum of the primary winding signal is detected by the filter.

In a related embodiment, the lamp system may include the one or more lamps and the one or more lamps may be T5 fluorescent lamps. In another related embodiment, the particular characteristic of the frequency spectrum of the primary winding signal detected by the filter ma be a presence of an even harmonic having a magnitude that exceeds a threshold value. In yet another related embodiment, the particular characteristic of the frequency spectrum of the primary winding signal detected by the filter may be a presence of a second harmonic having a magnitude that exceeds a threshold value.

In still another related embodiment, the inverter may be a half bridge resonant inverter having a first switch and a second switch, the first switch and the second switch each having a base terminal, an emitter terminal, and a collector terminal, wherein the lamp driver circuit may further include a shut down circuit connected to the second switch and to the control circuit to short the base terminal and the emitter terminal of the second switch when the particular characteristic of the frequency spectrum of the primary winding signal is detected by the filter. In yet still another related embodiment, the inverter circuit may be adapted to selectively energize a plurality of lamp configurations, wherein each of the plurality of lamp configurations may have a particular frequency spectrum that is indicative of an EOL condition for the lamp configuration, and wherein the filter may be configured to detect the particular characteristic of each of the particular frequency spectrums for the plurality of lamp configurations.

In still yet another related embodiment, the primary winding may include a first primary winding and a second primary winding that is coupled with the first primary winding, and the filter may be connected to the second primary winding to receive the primary winding signal. IN yet another related embodiment, the filter may be a band-pass filter having a center frequency that is substantially equivalent to an even harmonic of the frequency spectrum of the primary winding.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
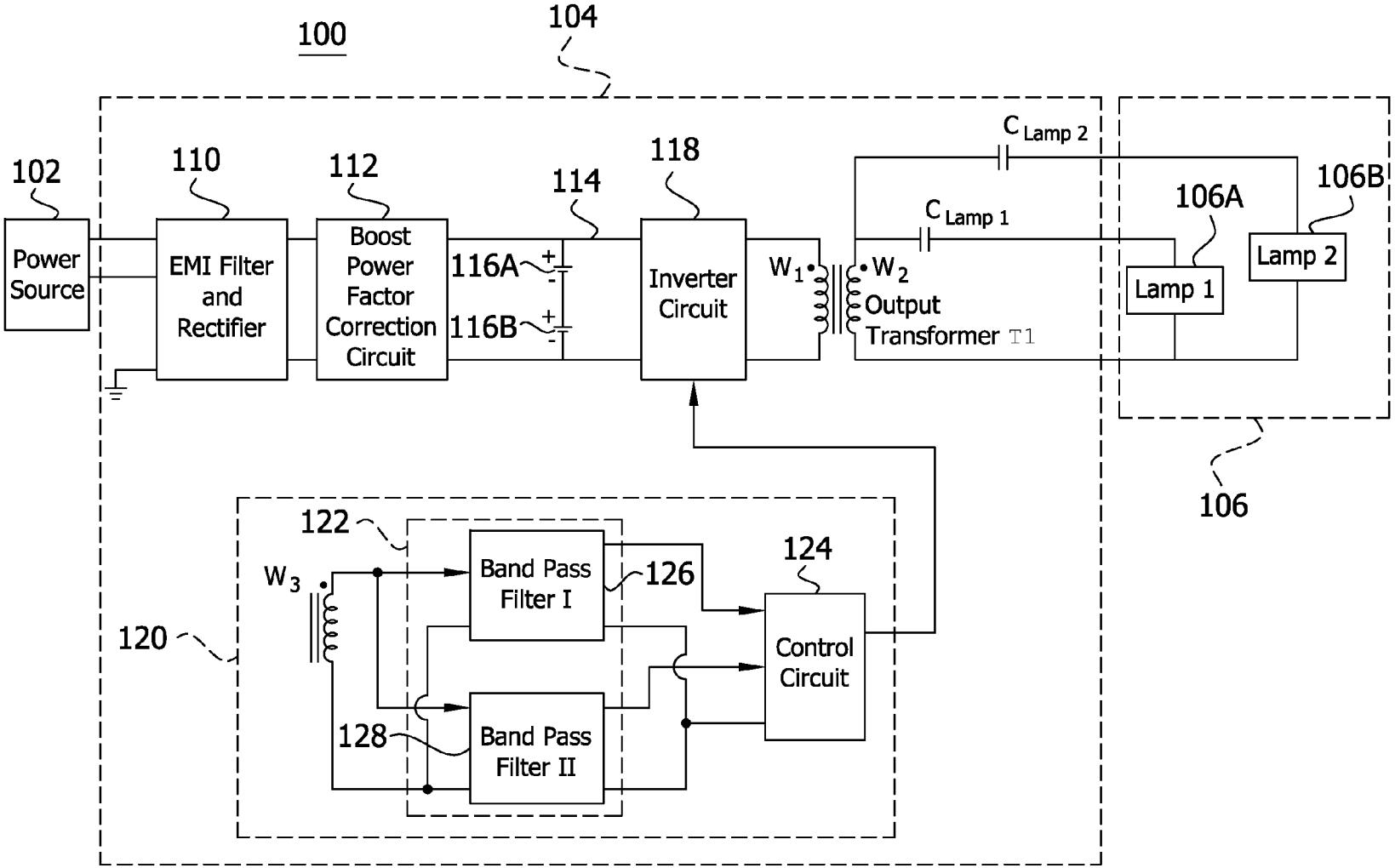
FIG. 1 is a schematic of a lamp system having a ballast for use with an input power source to energize a lamp according to embodiments disclosed herein.

FIG. 1 illustrates a lamp system 100 that includes an input power source 102, such as but not limited to an alternating current (AC) power source, an electronic ballast 104, and a lamp 106. Although the lamp 106 is illustrated in FIG. 1 as two lamps 106A and 106B, the lamp 106 may be one lamp or a plurality of lamps connected together in parallel. In some embodiments, the lamp 106 is a fluorescent lamp, such as but not limited to a T5 or a T8 fluorescent lamp. However, the lamp system 100 may be used for energizing other types of lamps without departing from the scope of the invention.

The electronic ballast 104 includes one or more input terminals adapted to connect to the input power source 102 and a ground terminal connectable to ground potential. In some embodiments, the input power source 102 includes a first voltage source and a second voltage source. The electronic ballast 104 is operatively connected to either the first voltage source or the second voltage source. Thus, the electronic ballast 104 may selectively receive power from either the first voltage source (e.g., 208 volts AC) or the second voltage source (e.g., 347 volts, 480 volts). Other input power sources 102 known in the art may be used without departing from the scope of the present invention. Although the illustrated electronic ballast 104 is a so-called instant start ballast, other electronic ballasts may be used in connection with the aspects described below without departing from the scope of the invention.

The electronic ballast 104 receives an input AC power signal from the input power source 102 via the input terminal. In some embodiments, the electronic ballast 104 includes an electromagnetic interference (EMI) filter and a rectifier (e.g., full-wave rectifier), illustrated generally at 110. The EMI filter in the EMI filter and rectifier 110 prevents noise, which may be generated by the electronic ballast 104, from being transmitted back to the input power source 102. The rectifier in the EMI filter and rectifier 110 converts AC voltage of the input power signal to DC (direct current) voltage.

The electronic ballast 104 also includes a power stage to convert power supplied by the input power source 102 to drive the lamps 106A and 106B. In FIG. 1, the electronic ballast 104 includes a power stage comprising a power factor control circuit, such as a boost converter (i.e., boost power factor correction circuit 112). The boost power factor correction circuit 112 receives the rectified input power signal and produces a high DC voltage (e.g., 450 volts DC) to a DC voltage bus 114 connected to an output of the boost power factor correction circuit 112. An inverter circuit 118, such as but not limited to a current fed half bridge inverter and start up circuit are connected to the DC voltage bus 114 and convert the DC voltage to AC voltage suitable for selectively energizing the lamps 106A and 106B. One or more capacitors, such as but not limited to electrolytic capacitors 116A and 116B shown in FIG. 1, may be connected in a shunt configuration across the output of the boost power factor correction circuit 112 to provide a low impedance source of voltage to the inverter circuit 118. The inverter circuit 118 includes an output transformer having a primary winding $W_1$ and a secondary winding $W_2$ to provide voltage to the lamps 106A and 106B.

The electronic ballast 104 also includes an end of life (EOL) detection circuit 120 to detect an occurrence of an EOL condition in the lamps 106A and 106B. When the EOL detection circuit 120 detects the occurrence of an EOL condition, such as but not limited to lamp failure, the EOL detection circuit 120 shuts down the inverter circuit 118 so that energizing of the lamps 106A and 106B is discontinued. In the lamp system 100, the EOL detection circuit 120 includes another primary winding (hereinafter a "detect winding") $W_3$ of an output transformer T1, a filter 122, and a control circuit 124. The detect winding $W_3$ is coupled (e.g., magnetically coupled) with a primary winding $W_2$ since they are wound on the same core. Accordingly, the detect winding $W_3$ generates a signal (hereinafter a "primary winding signal") that has a frequency spectrum representative of the frequency spectrum of the voltage across the primary winding $W_2$. The filter 122 is connected to the detect winding $W_3$ and receives the primary winding signal. The filter 122 detects a predefined characteristic of the frequency spectrum of the primary winding signal that is indicative of the EOL condition of the lamps 106A and 106B, and generates an output signal accordingly. The control circuit 124 is connected to the inverter circuit 118 and to the filter 122. In particular, the control circuit 124 receives the output signal generated by the filter 122 that is indicative of whether the predefined characteristic of the frequency spectrum is present in the primary winding signal. When the received output signal indicates that the predefined characteristic of the frequency spectrum is present in the primary winding signal, the control circuit 124 shuts down the inverter circuit 118 (e.g., via a shut down signal provided to the inverter circuit 118) so that the lamps 106A and 106B are de-energized. For example, the output signal may have a high value (e.g., greater than a pre-defined value) when the particular characteristic of the frequency spectrum is present in the primary winding signal. The control circuit 124 initiates a timer when the output signal turns high. When the control circuit 124 determines that the output signal has had a high value for a pre-defined amount of time (e.g., 5 second time period), the control circuit 124 shuts down the inverter circuit 118.

Figure 2:
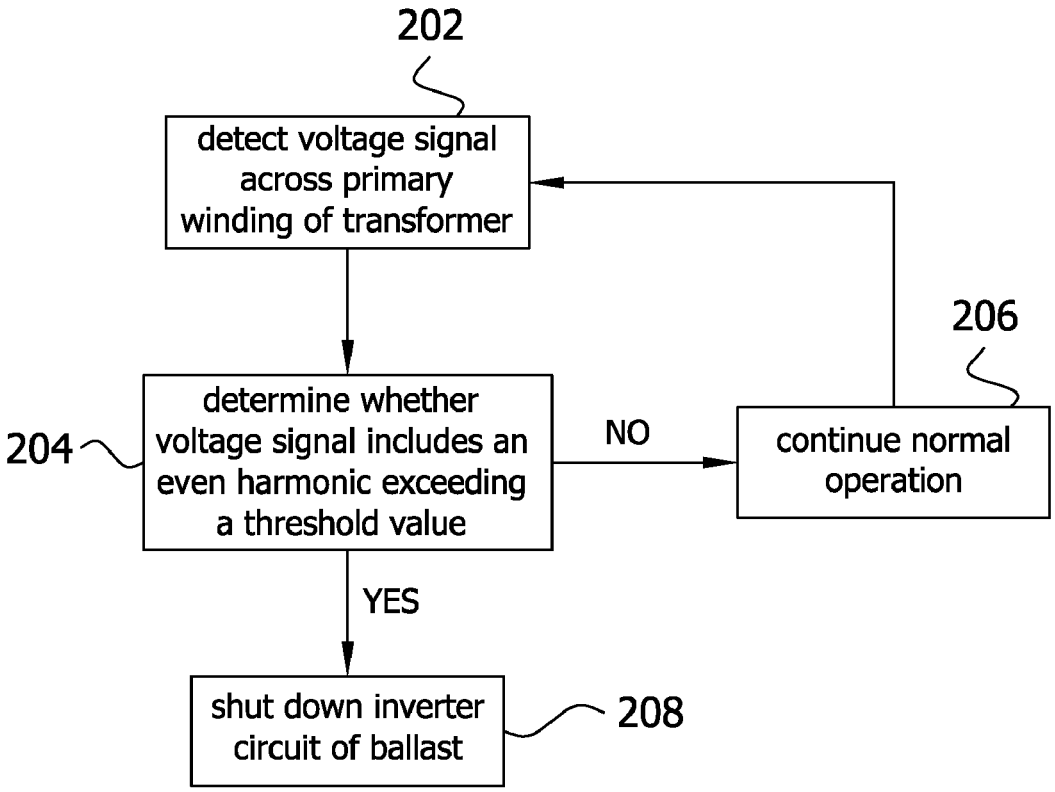
FIG. 2 is a flow chart illustrating steps performed by a detection circuit to detect an end of life condition according to embodiments disclosed herein.

Referring to FIG. 2, the presence of even harmonics, such as a second harmonic, is the particular characteristic of the frequency spectrum that indicates the lamp 106 being operated by the electronic ballast 104 has reached the EOL stage. FIG. 2 illustrates the steps performed by the EOL detection circuit 120. At 202, the EOL detection circuit 120 detects a voltage signal (e.g., primary winding signal) across the primary winding $W_2$ of the transformer T1 shown in FIG. 1. At 204, the EOL detection circuit 120 determines whether the voltage signal includes an even harmonic having a magnitude that exceeds a threshold value (e.g., 3.3 Volts). If the EOL detection circuit 120 determines that the voltage signal does not include an even harmonic having a magnitude that exceeds the threshold value, at 206 normal operation of the electronic ballast 104 is continued. As such, the inverter circuit 118 continues to energize the lamps 106A and 106B. If the EOL detection circuit 120 determines that the voltage signal includes an even harmonic having a magnitude that exceeds the threshold value, at 208 the inverter circuit 118 of the electronic ballast 104 is shut down. As such, the inverter circuit 118 discontinues energizing the lamps 106A and 106B.

In some embodiments, such as shown in FIG. 1, the lamp system 100 may have a plurality of lamps 106 connected together in parallel, and the electronic ballast 104 is thus adapted to supply power to a number of different lamp configurations. For example, in the lamp system 100 illustrated in FIG. 1, the electronic ballast 104 is adapted to supply power to two different lamp configurations: a one lamp configuration, and a two lamp configuration. In other embodiments, the electronic ballast 104 may be adapted to supply power to other configurations, such as but not limited to a three lamp configuration and/or a four lamp configuration. According to the one lamp configuration, the electronic ballast 104 supplies power to energize a single lamp (i.e., either the lamp 106A or the lamp 106B). When the electronic ballast 104 is supplying power to energize a single lamp (i.e., one lamp mode), the primary winding signal has a first frequency spectrum. According to the two lamp configuration, the electronic ballast 104 supplies power to simultaneously energize two lamps (i.e., both the lamp 106A and the lamp 106B). When the electronic ballast 104 is supplying power to energize two lamps, the primary winding signal has a second frequency spectrum. The filter 122 is configured to detect a particular characteristic of each of the frequency spectrums that are associated with the different lamp configurations supported by the electronic ballast 104. Accordingly, in the lamp system 100 shown in FIG. 1, the filter 122 includes a first band-pass filter 126 tuned to detect the particular characteristic of the first frequency spectrum indicative of the EOL condition for the one lamp configuration and to generate a first output signal accordingly. The filter 122 also includes a second band-pass filter 128 tuned to detect the particular characteristic of the second frequency spectrum indicative of the EOL condition for the two lamp configuration, and to generate a second output signal accordingly. The filter 122 may be similarly adapted depending on the lamp configuration (e.g., three lamps, four lamps, etc.).

In some embodiments, a presence of a second harmonic in the frequency spectrum of the primary winding signal is used to detect the EOL condition for the lamps 106A and 106B. Accordingly, the first band-pass filter 126 has a center frequency that is substantially equal to the second harmonic of the first frequency spectrum. The first band-pass filter 126 generates a first output signal that indicates whether the first frequency spectrum includes a second harmonic having a magnitude that exceeds a threshold value. Similarly, the second band-pass filter 128 has a center frequency that is substantially equal to the second harmonic of the second frequency spectrum. The second band-pass filter 128 generates a second output signal that indicates whether the second frequency spectrum includes a second harmonic having a magnitude that exceeds a threshold value. As such, when the electronic ballast 104 is operating in one lamp mode, the control circuit 124 receives the first output signal from the first band-pass filter 126 and determines, as a function thereof, whether the single lamp (e.g., the lamp 106A or the lamp 106B) that is being operated by the electronic ballast 104 is at the EOL stage. When the ballast 104 is operating in two lamp mode, the control circuit 124 receives the second output signal from the second band-pass filter 128 and determines, as a function thereof, whether one or more of the lamps 106A and 106B being operated by the electronic ballast 104 are at the EOL stage.

Figure 3:
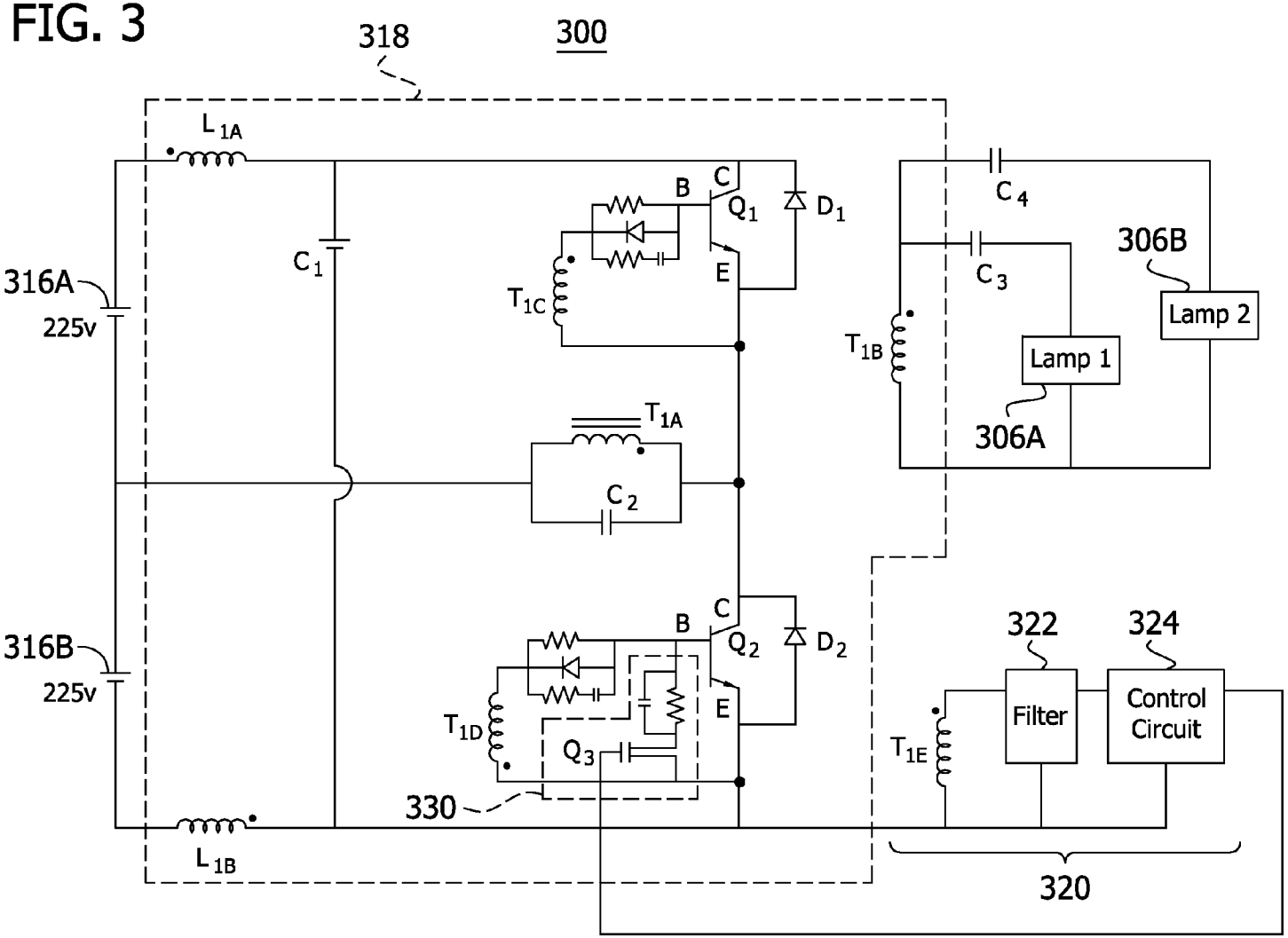
FIG. 3 is a circuit schematic of a lamp driver circuit according to embodiments disclosed herein.

FIG. 3 is a schematic of a lamp driver circuit 300 for a lamp system, such as but not limited to the lamp system 100 shown in FIG. 1. The lamp driver circuit 300 includes an inverter circuit 318 to convert DC voltage to AC voltage to energize lamps 306A and 306B, and an EOL detection circuit 320 to detect an EOL condition for the lamps 306A and 306B, and to shut down the inverter circuit 318 as a function thereof. Each of the lamps 306A and 306B has an associated lamp capacitor $C_3$, $C_4$, connected in series with its respective lamp 306A, 306B between the output transformer and the respective lamp 306A, 306B to define the current provided to the respective lamp 306A, 306B. Of course, in embodiments where only a single lamp is present (not shown in FIG. 3), there is only a single lamp capacitor associated with that lamp.

In the lamp driver circuit 300, the inverter circuit 318 is a half-bridge resonant inverter, though in other embodiments, other types of inverter circuits may be used. In particular, the inverter circuit 318 includes a first switch $Q_1$ and a second switch $Q_2$ to oppositely operate between a conductive state and a non-conductive state in order to provide an AC voltage to the lamps 306A and 306B, as generally known in the art. In FIG. 3, the first switch $Q_1$ and the second switch $Q_2$ are each transistors having a base terminal B, an emitter terminal E, and a collector terminal C. The inverter circuit 318 includes a current choke transformer having a primary winding $L_{1A}$ and a secondary winding $L_{1B}$. The inverter circuit 318 also includes an output transformer as generally described above. The output transformer has five windings ($T_{1A}$, $T_{1B}$, $T_{1C}$, $T_{1D}$, and $T_{1E}$), which are all wound on the same core. In particular, the output transformer includes a primary winding $T_{1A}$ and a secondary winding $T_{1B}$. Winding $T_{1C}$ and $T_{1D}$ provide base drives for the first switch $Q_1$ and the second switch $Q_2$, respectively. Winding $T_{1E}$ is another primary winding that forms the detect winding included in the EOL detection circuit 320 described above.

The inverter circuit 318 includes a shutdown circuit 330 connected between the base B and the emitter E of the second switch $Q_2$ and connected to the EOL detection circuit 320. The shutdown circuit 330 comprises a shut down switch $Q_3$ connected to the emitter E of the second switch $Q_2$, and a capacitor and a resistor connected together in parallel and connected between the shutdown switch $Q_3$ and the base B of the second switch $Q_2$. When the EOL detection circuit 320 determines that the EOL condition exists for at least one of the lamps 306A and 306B, the EOL detection circuit 320 generates a shutdown signal that is fed into the shutdown switch $Q_3$ to turn on the shutdown switch $Q_3$. When the shutdown switch $Q_3$ is turned on, it operates in a conductive state and thereby shorts the base B and the emitter E of the second switch $Q_2$, causing the inverter circuit 318 to discontinue energizing the lamps 306A and 306B.

In some embodiments, the functionality of the circuits shown in FIGS. 1 and/or 3, and/or portions thereof, may be performed using a combination of a controller and associated firmware (i.e., instructions, including but not limited to a software program) in place of one or more discrete circuit elements. Thus, the methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lamp driver circuit comprising:

an inverter circuit to selectively energize one or more lamps, the inverter circuit having a transformer to provide voltage to the one or more lamps, the transformer having a primary winding connected to a direct current (DC) voltage bus and a secondary winding to connect to one or more lamps;

a filter connected to the primary winding to receive a primary winding signal representative of the voltage across the primary winding, wherein the primary winding signal has a frequency spectrum and the filter detects a particular characteristic of the frequency spectrum of the primary winding signal, and wherein the particular characteristic of the frequency spectrum is indicative of an end of life (EOL) condition of the one or more lamps; and a control circuit connected to the inverter circuit and to the filter, wherein the control circuit is configured to discontinue energizing of the one or more lamps by the inverter circuit when the particular characteristic of the frequency spectrum of the primary winding signal is detected by the filter.

2. The lamp driver circuit of claim 1 wherein the particular characteristic of the frequency spectrum of the primary winding signal detected by the filter is a presence of an even harmonic having a magnitude that exceeds a threshold value.

3. The lamp driver circuit of claim 1 wherein the particular characteristic of the frequency spectrum of the primary winding signal detected by the filter is a presence of a second harmonic having a magnitude that exceeds a threshold value.

4. The lamp driver circuit of claim 1 wherein the inverter is a half bridge resonant inverter having a first switch and a second switch, the first switch and the second switch each having a base terminal, an emitter terminal, and a collector terminal, wherein the lamp driver circuit further comprises a shut down circuit connected to the second switch and to the control circuit to short the base terminal and the emitter terminal of the second switch when the particular characteristic of the frequency spectrum of the primary winding signal is detected by the filter.

5. The lamp driver circuit of claim 1 wherein the inverter circuit is adapted to selectively energize a plurality of lamp configurations, wherein each of the plurality of lamp configurations has a particular frequency spectrum that is indicative of an EOL condition for the lamp configuration, and wherein the filter is configured to detect the particular characteristic of each of the particular frequency spectrums for the plurality of lamp configurations.

6. The lamp driver circuit of claim 1 wherein the primary winding comprises a first primary winding and a second primary winding that is coupled with the first primary winding, and the filter is connected to the second primary winding to receive the primary winding signal.

7. The lamp driver circuit of claim 1 wherein the filter is a band-pass filter having a center frequency that is substantially equivalent to an even harmonic of the frequency spectrum of the primary winding.

8. The lamp driver circuit of claim 1 wherein the lamp driver circuit is adapted to use in a ballast, the ballast comprising:

an electromagnetic interference filter configured to receive alternating current (AC) voltage from a power source;

a rectifier connected to the electromagnetic interference filter to convert the alternating current (AC) voltage to direct current (DC) voltage;

a power factor control circuit connected to the rectifier to produce a DC voltage output; and a DC voltage bus connected to the power factor control circuit to receive the DC voltage output from the power factor control circuit.

9. A method of detecting an end of life (EOL) condition for one or more lamps connected to a ballast and energized by the ballast, the ballast having a transformer, the method comprising:

detecting a voltage signal across a primary winding of the transformer;

determining whether the voltage signal includes an even harmonic having a magnitude that exceeds a threshold value; and shutting down an inverter circuit of the ballast when the voltage signal is determined to include an even harmonic having a magnitude that exceeds the threshold value.

10. The method of claim 9 wherein the even harmonic consists of the second harmonic.

11. The method of claim 9 wherein determining comprises determining whether the voltage signal includes an even harmonic that exceeds a threshold value for at least a pre-defined period of time, and wherein shutting down comprises shutting down an inverter circuit of the ballast when the voltage signal is determined to include an even harmonic having a magnitude that exceeds the threshold value for at least the pre-defined period of time.

12. The method of claim 9 wherein shutting down comprises turning on a shutdown switch that is connected to a half bridge inverter.

13. A lamp system comprising:

an electromagnetic interference filter configured to receive alternating current (AC) voltage from a power source;

a rectifier connected to the electromagnetic interference filter to convert the alternating current (AC) voltage to direct current (DC) voltage;

a power factor control circuit connected to the rectifier to produce a DC voltage output;

a DC voltage bus connected to the power factor control circuit to receive the DC voltage output from the power factor control circuit;

an inverter circuit to selectively energize one or more lamps, the inverter circuit having a transformer to provide voltage to the one or more lamps, the transformer having a primary winding connected to a direct current (DC) voltage bus and a secondary winding to connect to one or more lamps;

a filter connected to the primary winding to receive a primary winding signal representative of the voltage across the primary winding, wherein the primary winding signal has a frequency spectrum and the filter detects a particular characteristic of the frequency spectrum of the primary winding signal, and wherein the particular characteristic of the frequency spectrum is indicative of an end of life (EOL) condition of the one or more lamps; and a control circuit connected to the inverter circuit and to the filter, wherein the control circuit is configured to shut off the inverter circuit when the particular characteristic of the frequency spectrum of the primary winding signal is detected by the filter.

14. The lamp system of claim 13 wherein the lamp system includes the one or more lamps and the one or more lamps are T5 fluorescent lamps.

15. The lamp system of claim 13 wherein the particular characteristic of the frequency spectrum of the primary winding signal detected by the filter is a presence of an even harmonic having a magnitude that exceeds a threshold value.

16. The lamp system of claim 13 wherein the particular characteristic of the frequency spectrum of the primary winding signal detected by the filter is a presence of a second harmonic having a magnitude that exceeds a threshold value.

17. The lamp system of claim 13 wherein the inverter is a half bridge resonant inverter having a first switch and a second switch, the first switch and the second switch each having a base terminal, an emitter terminal, and a collector terminal, wherein the lamp driver circuit further comprises a shut down circuit connected to the second switch and to the control circuit to short the base terminal and the emitter terminal of the second switch when the particular characteristic of the frequency spectrum of the primary winding signal is detected by the filter.

18. The lamp system of claim 13 wherein the inverter circuit is adapted to selectively energize a plurality of lamp configurations, wherein each of the plurality of lamp configurations has a particular frequency spectrum that is indicative of an EOL condition for the lamp configuration, and wherein the filter is configured to detect the particular characteristic of each of the particular frequency spectrums for the plurality of lamp configurations.

19. The lamp system of claim 13 wherein the primary winding comprises a first primary winding and a second primary winding that is coupled with the first primary winding, and the filter is connected to the second primary winding to receive the primary winding signal.

20. The lamp driver circuit of claim 13 wherein the filter is a band-pass filter having a center frequency that is substantially equivalent to an even harmonic of the frequency spectrum of the primary winding.

* * * * *